United States Patent [19]

Satake et al.

[11] Patent Number: 4,853,361

[45] Date of Patent: Aug. 1, 1989

[54] HEAT- AND LIGHT-SENSITIVE RECORDING MATERIAL

[75] Inventors: Toshimi Satake; Toshiaki Minami; Tomoaki Nagai; Fumio Fujimura, all of Tokyo, Japan

[73] Assignee: Jujo Paper Co., Ltd., Tokyo, Japan

[21] Appl. No.: 181,711

[22] Filed: Apr. 14, 1988

[30] Foreign Application Priority Data

Apr. 17, 1987 [JP] Japan ..... 62-94595

[51] Int. Cl.[4] ..... B41M 5/18; G03C 5/00

[52] U.S. Cl. ..... 503/201; 427/151; 428/913; 428/914; 430/338; 430/343; 430/945; 503/221; 503/223

[58] Field of Search ..... 427/151, 150, 152; 503/217, 221, 201, 223; 428/913, 914; 430/338, 343, 945

[56] References Cited

FOREIGN PATENT DOCUMENTS 2074687 4/1987 Japan ..... 503/221

*Primary Examiner*—Bruce H. Hess

*Attorney, Agent, or Firm*—Koda and Androlia

[57] ABSTRACT

A heat- and light-sensitive recording material has a substrate and a color-forming layer which comprises a particular fluoran-type leuco dye.

This heat- and light-sensitive recording material provides a clear image a superior contamination-resistance and an excellent readability in visible and near infrared range.

8 Claims, No Drawings

HEAT- AND LIGHT-SENSITIVE RECORDING MATERIAL

BACKGROUND OF THE INVENTION

1. Field of the Invention

This invention relates to a heat- and light-sensitive recording material in which an image is formed under heat energy and photo-energyl and a heat-sensitive recording method therefor.

2. Prior Art

Hitherto, various recording methods were proposed in using a color-forming reaction between a colorless or pale colored basic dye and an organic or inorganic electron-accepting compound under application of energies of pressure, heat, electricity, light etc. Among these recording methods, a heat-sensitive recording sheet is produced by applying on a substrate, such as paper, synthetic paper, film, plastic, etc., a coating color which is prepared by individually grinding and dispersing a colorless or pale colored basic dye and an electron-accepting compound (an organic color-developing agent) into fine particles, mixing the resultant dispersion with each other and then adding thereto binder, filler, sensitizer, slipping agent an other auxiliaries.

In using the heat-sensitive recording sheet, a recording is performed by undergoing instantaneously a chemical reaction when heated by thermal pen, thermal head, lazer beam, etc. This heat recording method has found a wide range of applications including industrial measurement recording instruments, terminal printers of computer, facsimile equipments, automatic ticket vending machines, printer for bar-code-label, and so on.

SUMMARY OF THE INVENTION

For recording, i.e. forming a colored image, a heat-sensitive recording sheet must comprise two ingredients consisting of a basic colorless dye as electron donor and acid as electron acceptor. In general, two ingredients are contained in one layer as a color-developing layer, wherein a contamination due to color-formation often occurs in the process for manufacturing the heat-sensitive recording sheet in the storage and the treatment of this sheet.

Accordingly, it is the main object of this invention to provide a recording material based on heat-sensitive recording in which this contamination does not occur. It is another object of this invention to provide the recording method using the above recording material.

The above objects can be performed by using a heat- and light-sensitive material having on a substrate an color-forming layer which contains an electrondonating compound and does not contain an electronaccepting compound, said electron-donating compound comprising at least one dye selected from fluoran-type leuco dyes of the following formula (I)

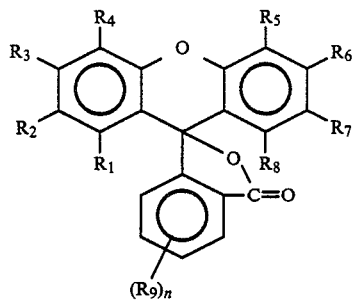

(I)

wherein at least one of $R_1$, $R_2$, $R_3$, $R_4$, $R_5$, $R_6$, $R_7$, $R_8$ and $R_9$ represents

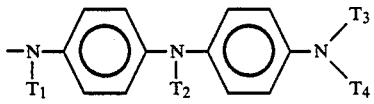

the remainders of $R_1$, $R_2$, $R_3$, $R_4$, $R_5$, $R_6$, $R_7$, $R_8$ and $R_9$ which may be the same or different, represent a hydrogen atom, an alkyl group, an alkoxy group, a cycloalkyl group, a halogen atom, a nitro group, a hydroxy group, an amino group, a substi-tuted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group or a $C_3$–$C_9$ alkinyl group;

$T_4$ represents a hydrogen atom, a $C_1$–$C_8$ alkyl group, a $C_3$–$C_9$alkenyl group, a $C_3$–$C_9$ alkinyl group or a phenyl group; in addition, $T_3$ and $T_4$ taken together with the nitrogen to which they are attached, may represent a morpholino group, a pyrrolidino group, a piperidino group or a hexamethylenimino group; and n represents an integer from 0 to 4.

The recording method of this invention has a feature that a thermal pattern is applied to a heat- and light-sensitive material of this invention for the formation of a latent image, and then a light is irradiated thereon for the formation of a visible image from the latent image.

DETAILED DESCRIPTION OF THE INVENTION

Hereinafter, this invention is described in detail.

The recording material of this invention must contain an electron-donating compound, particularly a basic colorless dye of the above formula (I) and does not contain an electron-accepting compound. The visible image is not obtained only by the application of the thermal pattern owing to absence of the electron-accepting compound.

Among the fluorantype leuco dyes of the formula (I), the dyes of the following general formula (II) is preferable.

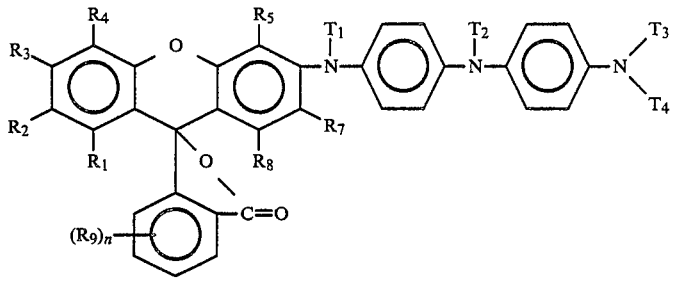

(II)

wherein $R_1$, $R_2$, $R_3$, $R_4$, $R_5$, $R_6$, $R_7$, $R_8$, $R_9$, $T_1$, $T_2$, $T_3$, $T_4$ and n are as defined above.

Taking the productivity, costs and performances into consideration, 2-methyl-6-p-(p-dimethylaminophenyl-)aminoanlinofluoran (m.p 197–230° C.) of the following formula (III) and 2-chloro-3-methyl-6-p-(p-phenylaminophenyl)aminoanilinofluoran (m.p: 191.5–196° C.) of the following formula (IV) are most preferable.

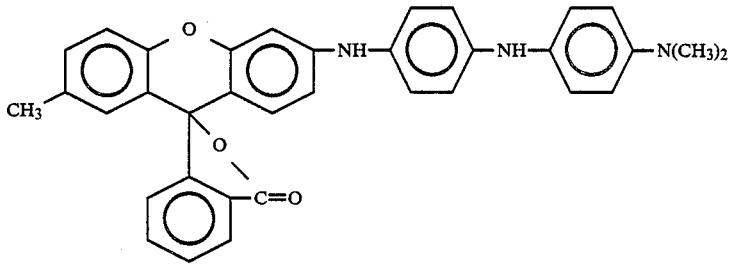

(III)

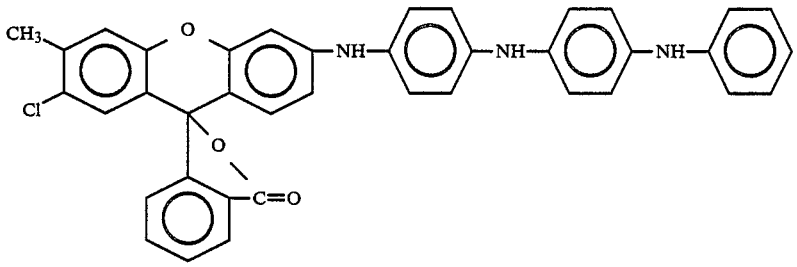

(IV)

The fluoran type leuco dyes of this invention are not particularly limited and include, for example, 2-methyl-6-p-(p-dimethylaminophenyl)aminoanilinofluoran, 2-methoxy-6-p-(p-dimethylaminophenyl)aminoanilinofluoran, 2-chloro-6-p-(p-dimethylaminophenyl-)aminoanilinofluoran, p-nitro-6-p-(p-diethylaminophenyl)aminoanilinofluoran, 2-amino-6-p-(p-diethylaminophenyl)aminoanilinofluoran, 2-diethylamino-6-p-(p-diethylaminophenyl)aminoanilinofluoran, 2-phenyl-6-p-(p-phenylaminophenyl)aminoanilinofluoran, 2-benzyl-6-p-(p-penylaminophenyl)aminoanilinofluoran, 2-hydroxy-6-p-(p-phenylaminophenyl) aminoanilinofluoran, 3-methyl-6-p-(p-dimethylaminophenyl)aminoanilinofluoran, 3-diethylamino-6-p-(p-diethylaminophenyl)aminoanilinofluoran, 3-diethylamino-6-p-(p-dibuthylaminophenyl)aminoanilinofluoran, 3-methyl-7-p-(p-dimethylaminophenyl)aminoanilinofluoran, 3-methoxy-7-p-(p-dimethylaminophenyl-)aminoanilinofluoran, 3-chloro-7-p-(p-dimethylaminophenyl) aminoanilinofluoran, 3-nitro-7-p-(p-diethylaminophenyl) aminoanilinofluoran, 3-amino-7-p-(p-diethylaminophenyl) aminoanilinofluoran, 3-diethylamino-7-p-(p-diethylaminophenyl)aminoanilinofluoran, 3-phenyl-7-p-(p-phenylaminophenyl-)aminoanilinofluoran, 3-benzyl-7-p-(p-phenylaminophenyl)aminoanilinofluoran, 3-hydroxy-7-p-(p-phenylaminophenyl)aminoanilinofluoran, 2-methyl-7-p-(p-dimethylaminophenyl)aminoanilinofluoran, 2-diethylamino-7-p-(p-diethylamino)-7-p-(p-diethylamino-phenyl)aminoanilinofluoran, 2-diethylamino-7-p-(p-dibutylaminophenyl)aminoanilinofluoran, 2-p-(p-dimethylaminophenyl)aminoanilino-6-methylflouran; 2-p-(p-dimethylaminophenyl)aminoanilino-6-methoxyflouran, 2-p-(p-diemthylaminophenyl)aminoalinino-6-chlorofluoran, 2-p-(p-diethylaminophenyl)aminoanilino-6-nitrofluoran, 2-p-(p-diethylaminophenyl)aminoanilino-6-aminofluoran, 2-p-(p-diethylaminophenyl-)aminoanilino-6-diethylaminofluoran, 2-p-(p-phenylaminophenyl)aminoanilino-6-phenylfluoran, 2-p-(p-phenylaminophenyl)aminoanilino-6-benzylfluoran, 2-p-(p-phenylaminophenyl)aminoanilino-6-hydroxyfluoran, 2-p-(p-dimethylaminophenyl)aminoanilino-6-methylfluoran, 2-p-(p-diethylaminophenyl-)aminoanilino-6-diethylaminofluoran, 2-p-(p-phenylaminophenyl)aminoanilino-6-diethylaminofluoran, 3-p-(p-dimethylaminophenyl)aminoanilino-7-methylfluoran, 3-p-(p-dimethylaminophenyl-)aminoanilino-7-methoxyfluoran, 3-p-(p-dimethylaminophenyl)aminoanilino-7-chlorofluoran, 3-p-(p-diethylaminophenyl)aminoanilino-7-nitrofluoran, 3-p-(p-diethylaminophenyl)aminoanilino-7-aminofluoran, 3-p-(p-diethylaminophenyl)aminoanilino-7-diethylaminofluoran, 3-p-(p-phenylaminophenyl- )aminoanilino-7-phenylfluoran, 3-p-(p-phenylaminophenyl)aminoanilino-7-benzylfluoran, 3-p-(p-phenylaminophenyl)aminoanilino-7-hydroxyfluoran, 3-p-(p-dimethylaminophenyl)aminoanilino-7-methylfluoran, 3-p-(p-diethylaminophenyl)aminoanilino-7-diethylaminofluoran, and 3-p-(p-phenylaminophenyl-)aminoanilino-7-diethylaminofluoran.

In this invention, the fluoran type leuco dye is used alone or in combination.

The color-forming layer of this invention comprises the above basic colorless dye, if desired, a heat-meltable material, binder, filler and other additives.

In this invention, the heat-meltable material includes no electron-accepting material, but has a function of improving a color-developing sensitivity. The heat-meltable materials of this invention includes, for example: fatty acid amide such as stearinamide, palmitin amide, etc.; ethylenebisamide; montan wax; polyethylene wax; dimethyl terephthalate; benzyl p-benzyloxybenzoate; dibenzyl terephthalate; β-naphthylbenzoate; N-acetyldiphenyl amine; methyl p-nitrobenzoate; diphenyl carbonate; methyl p-benzyloxybenzoate; p-nitro benzaldehyde; fluorene; phenanthrene; β-naphthochinone; 4'-t-butylbenzyl-4-(4''-t-butyl-benzyloxy) benzoate; 4,4'-n-butoxydiphenylsulfone; p-tolyl carbonate; m-tolyl carbonate, o-tolyl carbonate; 1,2,3,4,5,6,7,8-octahydro anthracene; p-benzylbiphenyl; phenyl-4-biphenyl carbonate; phenyl-β-naphthyl carbonate; phenyl-β-naphthyl carbonate; β-naphthyl-p-tolylsulfonate; β-naphthylbenzene sulfonate; 4-biphenylbenzene sulfonate; phenyl -β-naphthaline sulfonate;

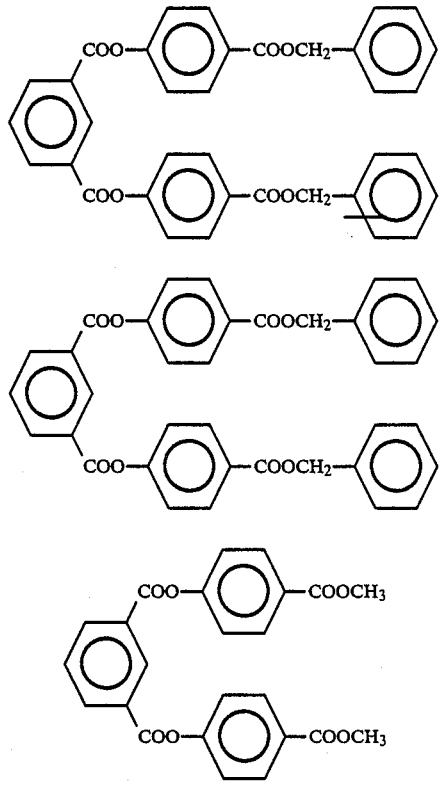

As the binders of this invention, there can be mentioned, for example, a fully saponified polyvinyl alcohol having a polymerization degree of 200–1900, a partially saponified polyvinyl alcohol, carboxylated polyvinyl alcohol, amide-modified polyvinyl alcohol, sulfonic acid-modified polyvinyl alcohol, butyralmodified polyvinyl alcohol, other modified polyvinyl alcohol, hydroxyethyl cellulose, methyl cellulose, carboxymethyl cellulose, styrene/malic acid anhydride copolymers, styrene/butadiene copolymers, cellulose derivatives such as ethyl cellulose, acetyl cellulose, etc.; polyvinyl chloride, polyvinyl acetate, polyacryl amide, polyacrylic acid ester, polyvinyl butyrol, polystyrol and copolymers thereof; polyamide resin, silicone resin, petroleum resin, terpene resin, ketone resin and cumaron resin.

These polymeric materials may be used after they were dissolved in a solvent such as water, alcohol, ketone, ester hydrocarbon, etc., or after they were emusified or dispersed in water or a solvent other than water.

The species and the amount of the basic colorless dye, heat-meltable material and other ingredients, which are used in this invention, are determined depending upon the performance and recording aptitude required for the recording material, and are not otherwise limited. However, in ordinary cases, it is suitable to use 1–8 parts by weight of heat-meltable material, 1–20 parts by weight of filler, and 10–25 parts by weight of binder, based on 1 part by weight of basic colorless dye.

The claimed heat- and light-sensitive recording material may be obtained by coating the above coating composition on a substrate such as paper, synthetic paper, film, etc.

The above basic colorless dye, if necessary, other ingredients are ground to a particle size of several microns or less by means of a grinder or emulsifier such as ball mill, attritor, sand mill, etc., and binders and various additives in accordance with the purpose, are added thereto to prepare a coating color.

Such additives are as follows: filler; releasing agent for prevention of sticking, such as fatty acid metal salt; anti-fogging agent such as fatty acid amide, ethylenebisamide, montan wax, polyethylene wax, etc.; dispersant such as sodium dioctylsulfosuccinate, sodium dodecylbenze sulfonate, sodium laurylalcohol sulfate, sodium alginate, etc; UV-absorber such as benzophenone type or triazole type; antifoamer; fluorescent brightening agent; water resistance agent; and so on.

As filler, there may be used any organic or inorganic filler usually used in the paper-manufacturing field. Examples for fillers of this invention include clay, talc, silica, magnesium carbonate, alumina, aluminum hydroxide, magnesium hydroxide, barium sulfate, kaolin, titanium dioxide, zinc oxide, calcium carbonate, aluminum oxide, urea-formalin resin, polystyrene resin, phenol resin, etc.

On the other hand, the recording method of this invention uses a recording material with a color-forming layer containing a fluoran-type leuco dye of the general formula (I). This recording method consists of two steps: thermal pattern-application for providing a latent image on the color forming layer, and light-irradiation for providing a visible image. The thermal pattern is applied by thermal pen, thermal head, laser beam, etc, while the light-irradiation is carried out with black light lamp, xenon-lamp, carbon arc lamp, wherein UV-light is most suitable.

The light-irradiation is instantaneous, short time, at most several minutes. The interval between the end of thermal pattern application and the beginning of the light irradiation is determined depending upon the conditions of the recording method of this invention. That is, the light is irradiated instantaneously, after several months storage or after several years storage of pattern-applied material. The obtained recorded image absorbs the light of visible region to near infrared region, that is, the light of 370–2000 nm.

The invention, using no electron-accepting material, may form a colored image which absorbs light of visible region to near infrared region (light of 370–2000 nm). The fluoran type leuco dye of this invention has a following moiety, in which two benzene nucleus are bonded to fluoran skeleton through three nitrogen atoms.

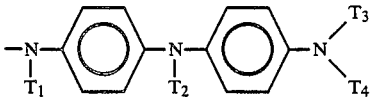

It is thought that in the light irradiation, the above moiety acts as an active point of photochemical reaction, and forms an absorber which absorbs light of visible region and near infrared region. Taking into consideration that either of a thermal patter application and a light irradiation does not provide a colored image, it is presumed that the basic colorless dye is melted and activiated by heat energy, and further the above photochemical reaction is carried out by photo energy to develop a color.

The following examples illustrate this invention, although the invention is not limited to examples. The parts are parts by weight. [EXAMPLE 1]

| Solution A (dispersion of dyestuff) | |
|---|---|
| Basic colorless dye (see Table 1) | 2.0 parts |
| 10% aqueous solution of polyvinyl alcohol | 4.6 parts |
| Water | 2.6 parts |

The solutions A of the above-mentioned composition was ground to a particle size of 3 microns by attritor. Then, the dispersions were mixed in the following portion to prepare the coating color.

| Coating Color | |
|---|---|
| Solution A | 9.2 parts |
| Kaolin clay (50% aqueous dispersion) | 12.0 parts |

The coating color was applied on one side of a base paper weighing 50 g/m$^2$ at a coating weight of 6.0 g/m$^2$ and was then dried. The resultant paper was treated to a smoothness of 200–600 seconds by a supercalender. In this manner a heat- and light-sensitive recording paper was obtained. [EXAMPLE 2]

| Solution B (dispersion of heat meltable material) | |
|---|---|
| Heatmeltable material (see Table 1) | 6.0 parts |
| 10% aqueous solution of polyvinyl alcohol | 18.7 parts |
| Water | 11.3 parts |

The solution B of the above-mentioned composition was ground to a particle size of 3 microns by attritor. Then, the dispersions were mixed in the following portion to prepare the coating color.

| Coating Color | |
|---|---|
| Solution A (dispersion of dyestuff) | 9.2 parts |
| Solution B (dispersion of heatmeltable materials) | 36.0 parts |
| Kaolin clay (50% aqueous dispersion) | 12.0 parts |

[COMPARATIVE EXAMPLE 1 (TEST NO. 7–8)]

A heat- and light-sensitive recording sheet was obtained in the same manner as in Example 1 except using solution C instead of solution A.

| Solution C | |
|---|---|
| Basic colorless dye (see Table 1) | 2.0 parts |
| 10% aqueous solution of polyvinyl alcohol | 4.6 parts |
| Water | 2.6 parts |

In this case, 3-diethylamino-6-methylanilinofluoran is a black-color forming dye used conventionally, and 3,6,6'-tris(dimethylamino) spiro[fluorene-9,3'-phthalide] is a dye in which the readability in the near infrared region was found to be superior.

With regard to the heat- and light-sensitive recording sheets of Examples and comparative Example, the test results are shown in Table 1.

TABLE 1

Test Results

| | Test No. | Basic colorless dye | Heatmeltable material | Image-density (1) | Reflectance of infrared ray (%) (2) |
|---|---|---|---|---|---|
| Example 1 | 1 | 2-methyl-6-p-(p-dimethylaminophynyl) aminoanilinofluoran | — | 0.81 | 67 |
| | 2 | 2-chloro-3-methyl-6-p-(p-phenylaminophenyl) aminoanilinofluoran | — | 0.82 | 66 |
| Example 2 | 3 | " | Stearin amide | 0.85 | 63 |

TABLE 1-continued

Test Results

| | Test No. | Basic colorless dye | Heatmeltable material | Image-density (1) | Reflectance of infrared ray (%) (2) |
|---|---|---|---|---|---|
| | 4 | " | 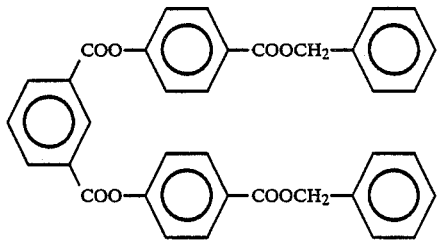 | 0.84 | 62 |
| | 5 | 2-methyl-6-p-(p-dimethylaminophenyl) aminoanilinofluoran | Stearin amide | 0.85 | 64 |
| | 6 | " | 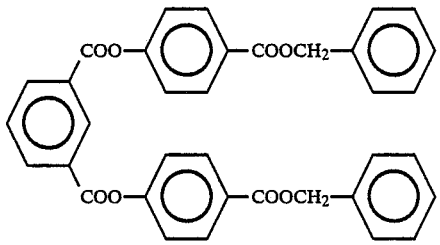 | 0.86 | 64 |
| Comparative Example 1 | 7 | 3-diethylamino-6-methyl-7-anilinofluoran | — | 0.05 | 100 |
| | 8 | 3,6,6'-tris (dimethylamino)spiro [fluorene-9,3'-phthalide] | — | 0.05 | 100 |

[NOTE]

(1) Image density: A recording sheet is recorded by a heat-sensitive label printer (TLP-150, manufactured by F & O Co.), and is subjected to light irradiation by a fade-O-meter (using carbon-arc lamp) for 5 minutes. The obtained image is measured by a Macbeth densitometer (RD-914, using amber filter).

(2) Reflectance of infrared ray

The recorded image printed in Note (1) is measured by a spectrophtometer (using a wave length of 940 nm).

As seen from Table 1, dyes of Comparative Example do not provide a colored image owing to the absence of an electron-accepting material, and a dye in Test No. 8, which is suitable for readability in near infrared region, absorbs no infrared light in absence of color-development. On the other hand, the dyes in Examples, even in absence of an electron-accepting material, provide an image and absorbs infrared light.

This invention exhibits following effects. (1) Clear image is obtained in absence of any electron-accepting agent (color-developing agent).

(2) Contamination due to color-development tends not to occur in the manufacturing process and the product storage owing to the absence of any color-developing agent.

(3) The optical readability in visible and near infrared range is superior so that the recording material may be used for bar-code label, etc.

We claim:

1. A heat- and light-sensitive recording material comprising a substrate having thereon a color-forming layer which contains a electron-donating compound and does not contain electron-accepting compound, said color-forming layer comprising as said electron-donating compound a fluoran-type leuco dye represented by the following general formula (I).

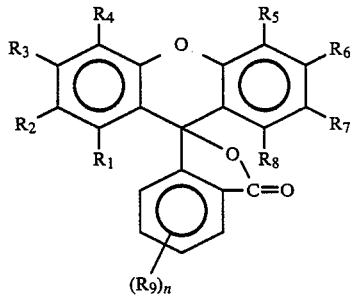

(I)

wherein at least one of $R_1$, $R_2$, $R_3$, $R_4$, $R_5$, $R_6$, $R_7$, $R_8$ and $R_9$ represents

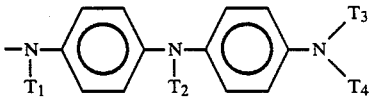

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group, or a $C_3$–$C_9$ alkinyl $T_4$ represents a hydrogen atom, a $C_1$–$C_8$ alkyl group, a $C_3$–$C_9$ alkenyl group, a $C_3$–$C_9$ alkinyl group or a phenyl group; in addition $T_3$ and $T_4$ taken together with the nitrogen to which they are attached, may represent, a morpholino group, a pyrrolidino group, a piperidino group or a hexamethylenimino group; and n represents an integer from 0 to 4

2. The recording material according to claim 1, wherein said fluoran-type leuco dye is at least one dye selected from a group consisting of 2-chloro-3-methyl-6-p-(p-phenylaminophenyl)aminoanilinofluoran and 2-methyl-6-p-(p-dimethylaminophenyl)aminoanilinofluoran.

3. The recording material according to claim 1 or 2, wherein said color-forming layer comprises 1–8 parts by weight of heat-meltable material, 1–20 parts by weight of filler and 10–25 parts by weight of binder, based on 1 part by weight of basic colorless dye.

4. The recording material according to claim 1, wherein said substrate is film.

5. A heat- and light-sensitive recording method, wherein a thermal pattern is applied to a heat- and light-sensitive material for the formation of a latent image, and then a light is irradiated thereon for the formation of a visible image, said heat- and light-sensitive material comprising a substrate having thereon a color-forming layer which contains electron-donating compound and does not contain electron-accepting compound, said color-forming layer comprising as said electron-donating a fluoran-type leuco dye represented by the following general formula (I).

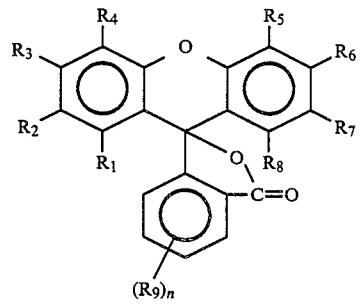

(I)

wherein at least one of $R_1$, $R_2$, $R_3$, $R_4$, $R_5$, $R_6$, $R_7$, $R_8$ and $R_9$ represents

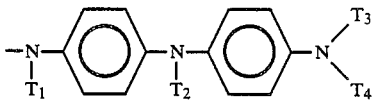

the remainders of $R_1$, $R_2$, $R_3$, $R_4$, $R_5$, $R_6$, $R_7$, $R_8$ and $R_9$, which may be the same or different, represent a hydrogen atom, an alkyl group, an alkoxy group, a cycloalkyl group, a halogen atom, a nitro group, a hydroxy group, an amino group, a substituted amino group, an aralkyl group, a substituted aralkyl group, an aryl group or a substituted aryl group;

$T_1$, $T_2$ and $T_3$, which may be the same or different, represent a hydrogen atom, a $C_3$–$C_9$ alkyl group, a $C_3$–$C_9$ alkenyl group, or a $C_3$–$C_9$ alkinyl group;

$T_4$ represents a hydrogen atom, a $C_1$–$C_8$ alkyl group, a $C_3$–$C_9$ alkenyl group, a $C_3$–$C_9$ alkinyl group or a phenyl group; in addition, $T_3$ and $T_4$ taken together with the nitrogen to which they are attached, may represent, a morpholino group, a pyrrolidino group, a piperidino group or a hexamethylenimino group; and n represent an integer from 0 to 4.

6. The recording method according to claim 5, wherein said thermal pattern is applied by a thermal pen or laser beam.

7. The recording method according to claim 5, wherein UV-light is used as said light.

8. The recording material according to claim 5, wherein said film is comprised of paper.

* * * * *